United States Patent [19]

Kyhl

[11] 3,988,017

[45] Oct. 26, 1976

[54] WORKPIECE FEEDING DEVICE

[75] Inventor: Henry C. Kyhl, Leonia, N.J.

[73] Assignee: Lockheed Electronics Co., Inc., Plainfield, N.J.

[22] Filed: Mar. 20, 1975

[21] Appl. No.: 560,381

[52] U.S. Cl. ..... 271/111; 271/10; 271/34; 271/259; 271/150

[51] Int. Cl.[2] ..... B65H 7/14; B65H 3/04

[58] Field of Search ..... 271/10, 34, 35, 37, 271/38, 110, 111, 114, 116, 117, 121, 124, 126, 256–259, 265, 150; 198/DIG. 16; 214/1 M

[56] References Cited

UNITED STATES PATENTS

| | | | |
|---|---|---|---|
| 1,976,788 | 10/1934 | Kurth | 271/35 |
| 3,108,801 | 10/1963 | Van Dalen | 271/34 |
| 3,347,348 | 10/1967 | Flint et al. | 271/10 |
| 3,486,819 | 12/1969 | Giulio | 271/114 |
| 3,575,410 | 4/1971 | Suzuki | 271/111 |
| 3,825,248 | 7/1974 | Friend | 271/10 |
| 3,927,876 | 12/1975 | Wojtowicz et al. | 271/10 |

FOREIGN PATENTS OR APPLICATIONS

| | | | |
|---|---|---|---|
| 19,703 | 8/1907 | Norway | 271/121 |

*Primary Examiner*—Robert W. Saifer
*Attorney, Agent, or Firm*—Billy G. Corber

[57] ABSTRACT

A device for feeding letter mail and the like from a stack of such non-uniform sheet-like articles for individual workpiece processing wherein a plurality of friction feeders define a path for the transfer of mail from the stack and are driven in a pulsing mode interdependently under the control of photoelectric cells to facilitate the automatic separation of workpiece doubles.

16 Claims, 6 Drawing Figures

FIG. 4
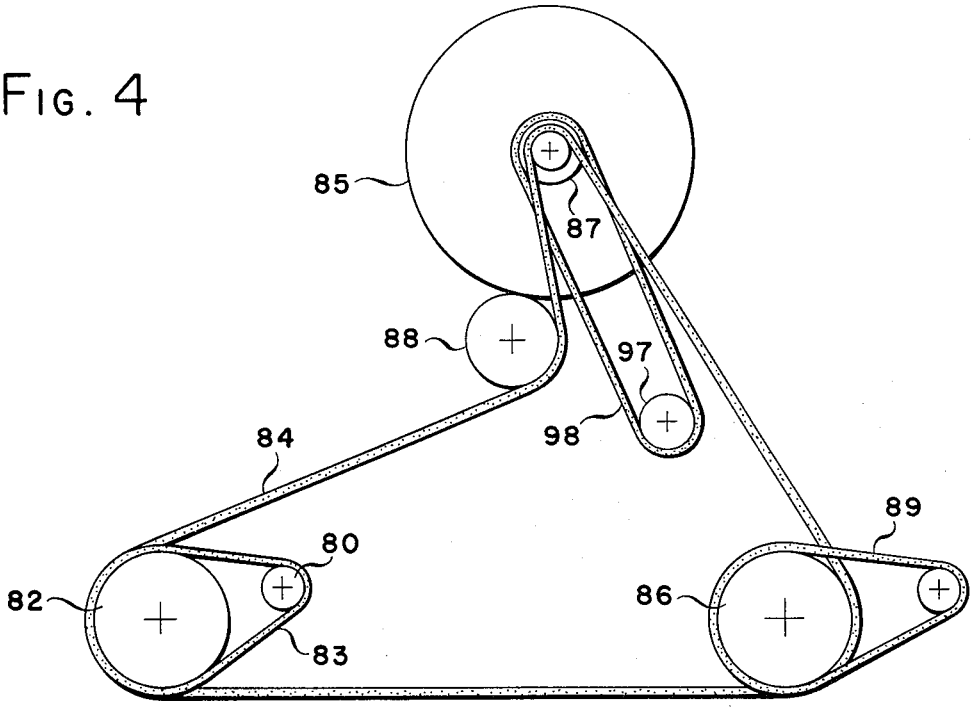
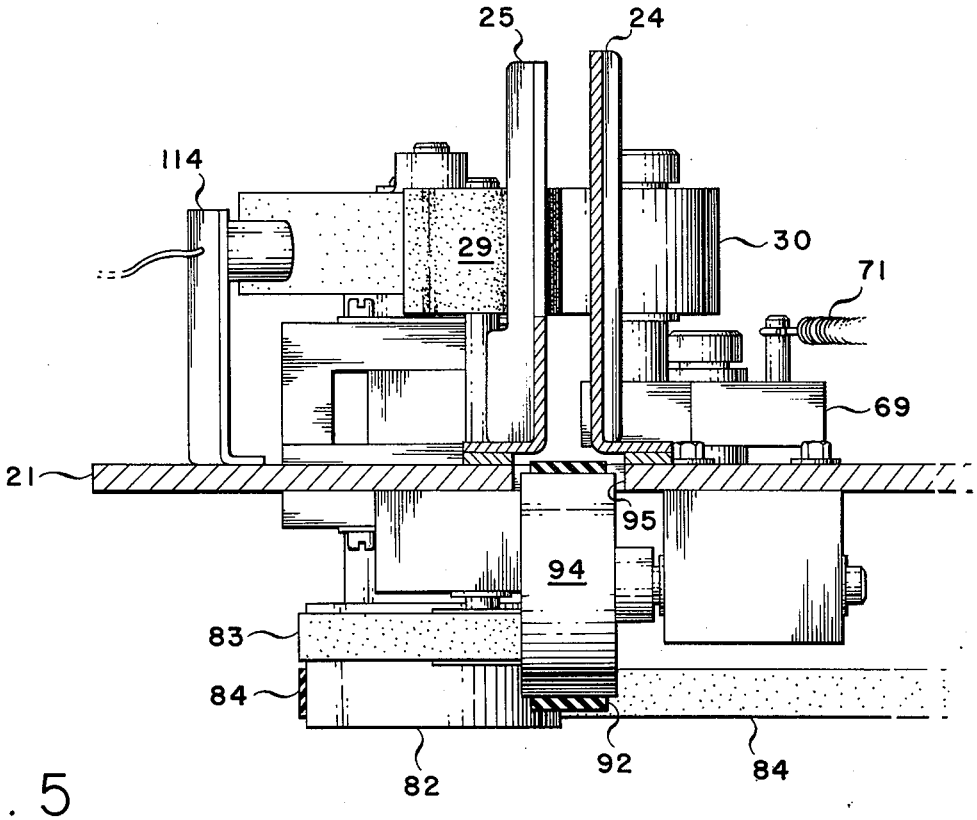
FIG. 5

WORKPIECE FEEDING DEVICE

BACKGROUND OF THE INVENTION

This invention relates to devices for feeding workpieces one at a time from a stack, and more particularly to the feeding of workpieces, such as letter mail or other non-uniform sheet-like articles on which some operation is to be performed. The field of art to which the invention most likely pertains is located in a class of devices generally relating to sheet feeding or delivering. Class 271, U.S. Patent Office Classification, may be the applicable general area of art in which the claimed subject matter of the type involved here may be classified.

Examples of prior devices in the arts to which this invention most likey pertains are disclosed in U.S. Pat. Nos. 3,186,708, 3,108,801, 3,103,355, 3,048,393, 3,025,051 and 2,856,187.

In feeding workpieces from a stack, when the workpieces are uniform in size and surface condition and of substantially the same length in the direction of feed, suitable timing mechanism such as disclosed in U.S. Pat. Nos. 2,973,202 and 3,264,630 may be provided to move workpieces forward in an orderly fashion for processing. However, where the workpieces are of varying length in the direction of feed and of varying surface conditions, such as in the processing of letter mail, those types of control mechanisms will not operate effectively. The longer workpieces will overlap in the flow from the stack or several workpieces will stick together, and the controls will not adjust to these changing conditions, causing too frequent interruption in the operation of the feed system.

The prior art devices which deal with removing workpieces of non-uniform size from a stack of mail or the like are generally incapable of separating doubles once taken from the stack. Whatever is pulled from the stack is fed through the device and those pieces of mail hidden behind other pieces either cause a stoppage or are not detected and properly processed.

SUMMARY OF THE INVENTION

An object of the present invention is to provide a feeding device for removing and separating workpieces from a stack of workpieces to permit individual workpiece processing with an uninterrupted flow of such workpieces for downstream processing, even when more than one at a time is unintentionally pulled from the stack.

In the specific embodiment of the invention shown and described herein, a plurality of feeders collectively define a prescribed path for the orderly flow of workpieces from a random stack of workpieces. At least one of the feeders engages the stack, and on pulsing motion of the feeder the lead workpiece contacting the feeder is pulled into the feeder system where it is picked up by a pair of nip rollers and advanced to a second stage feeder. A stationary scrubber is associated with each feeder stage and located relative to the workpiece path on the side opposite the feeder to aid in separating workpieces when more than one at a time is pulled from the stack. By strategically locating photoelectric sensors which interdependently control the feeders, workpiece doubles are separated before another workpiece is pulled from the stack and a continuous flow of workpieces are thereby made to emerge the device in single file for processing. System reliability can be enhanced simply by increasing the number of feeder stages. However, in practice the use of two stages have been found adequate to hold the doubles and misfed rate in the processing of letter mail to well under 1%.

The features of the present invention which are believed to be novel are set forth with particularly in the appended claims. This invention itself, both as to its organization and manner of operation, together with further objects and advantages thereof, may be best understood by reference to the following description taken in connection with the accompanying drawings.

BRIEF DESCRIPTION OF THE DRAWINGS

FIG. 4 is a view schematically showing the belt drive system for the feeder device;

FIG. 5 is a view taken approximately on line 5—5 of FIG. 2; and

DESCRIPTION OF THE PREFERRED EMBODIMENT

Figure 1:
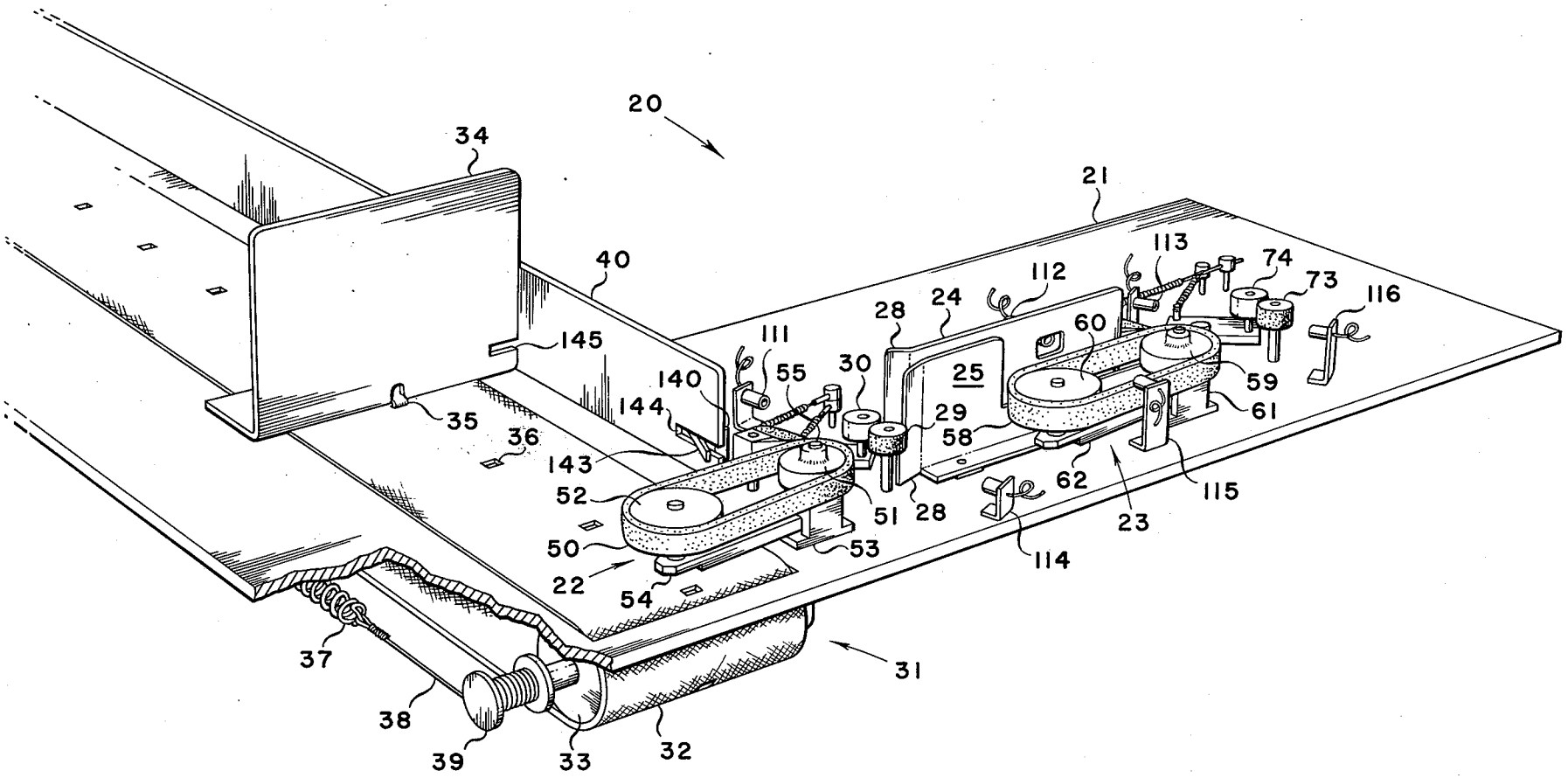
FIG. 1 is a fragmentary perspective view showing the feeder device of this invention in combination with a workpiece stacker.
Figure 2:
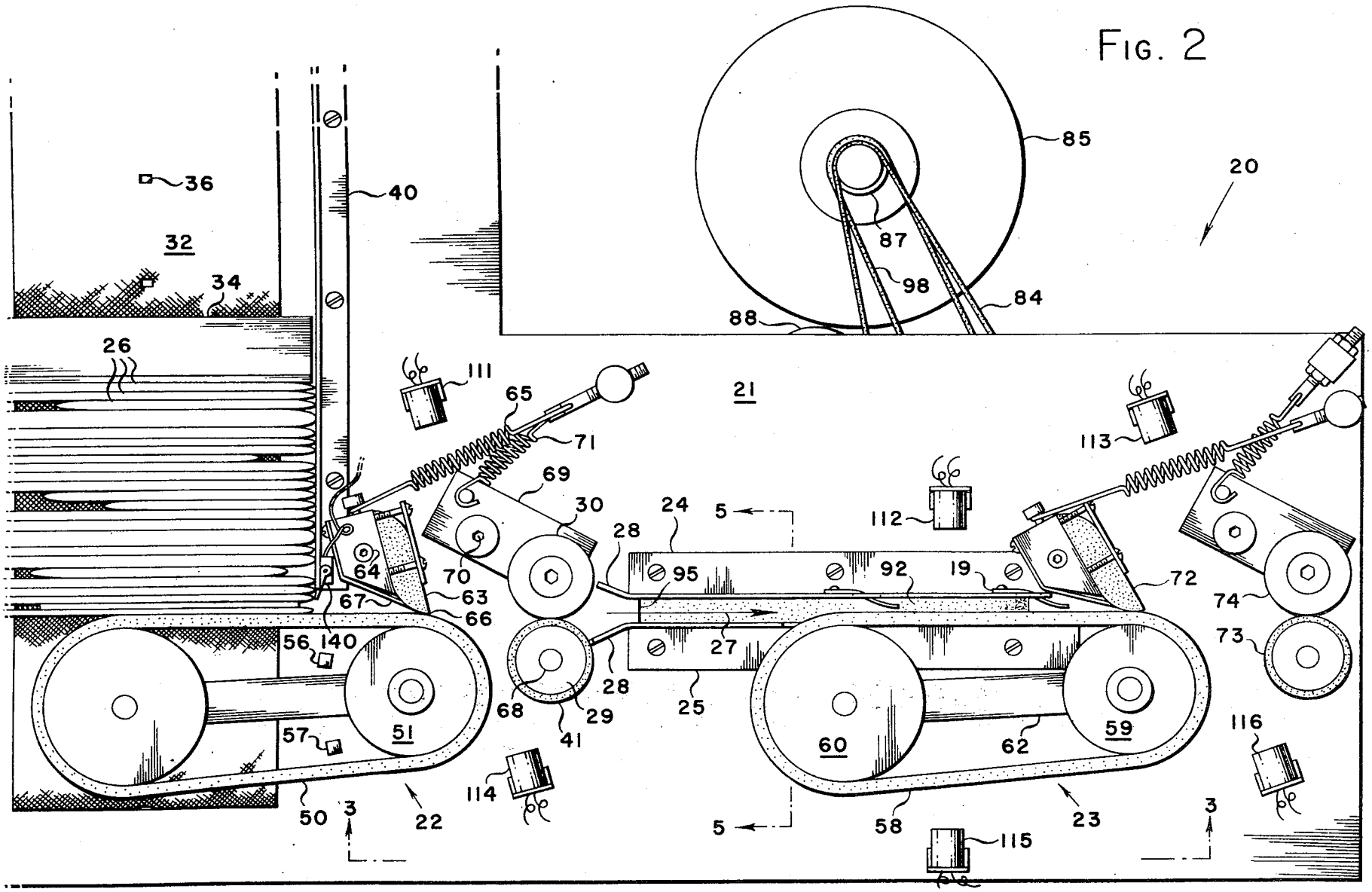
FIG. 2 is a plan view of the feeder and stacker combination.

Referring to FIGS. 1 and 2, the device 20 of this invention includes a table-like frame 21 for supporting a first stage feeder 22 and a second stage feeder 23, which, together with spaced guides 24 and 25 define a prescribed path for the flow of workpieces 26 as indicated by arrow 27 in FIG. 2. The upstream end of guides 24 and 25 are flared outwardly at 28 to facilitate the feeding of workpieces 26 into the space between guides 24 and 25 from a pair of nip rollers 29 and 30 interposed between the guides and first stage feeder 22.

First stage feeder 22 overhangs a stacker 31 having a conveyor belt 32 on which workpieces 26 are stacked to rest against the feeder as illustrated in FIG. 2. Referring specifically to FIG. 1, conveyor belt 32 is guided over a roller 33 for movement in a direction generally normal to feeder path 27. A movable platen 34 rests on conveyor belt 32 and is provided with a detent 35 which engages one of a series of notches 36 formed in the conveyor belt. A spring 37 tensions a line 38 wrapped around drum 39 fixed to roller 33 and urges belt 32 to move platen 34 and the stack of workpieces in the direction of feeder 22. By positioning platen 34 to engage a convenient one of the series of notches 36 in conveyor belt 32, workpiece stacks of various size may be accommodated while maintaining a nearly constant low stack pressure against feeder 22. A back plate 40 on frame 21 serves as a railing for properly aligning the stack of workpieces relative to feeder 22. The construction of stacker 31 forms no part of this invention apart from its use in combination with the feeder device disclosed herein.

Feeder 22 includes a friction belt 50 carried on a pair of pulleys 51 and 52. Pulley 51 is rotatably mounted on frame 21 through shaft 55 in riser 53 while pulley 52 is rotatably mounted on a swing arm 54 pivoted to riser 53 for swinging movement approximately coaxial with shaft 55 and within limits established by stops 56 and 57 shown in FIG. 2.

Second stage feeder 23 is constructed essentially the same as first stage feeder 22 with a friction belt 58 carried on a pair of spaced pulleys 59 and 60. Riser 61 supports pulley 59 above frame 21 and swing arm 62 supports pulley 60 for limited swinging movement into the workpiece path. By mounting pulley 52 associated with first stage feeder 22 and pulley 60 associated with second stage feeder 23 on their respective swing arms 54 and 62 so as to permit limited movement into the workpiece path, different workpiece thicknesses are accommodated while exerting a nearly uniform pressure on the workpieces at least during initial contact between the feeder and workpiece. If desired, one or more spring guide fingers 19 may also be provided on guide member 24 to project into the workpiece path for urging the workpieces against feeder belt 58.

As best shown in FIG 2, associated with feeder stages 22 and 23 on the opposite side of workpiece path 27 are scrubbers 63 and 72, respectively. Scrubber 63 is pivotally carried on a shaft 64 secured to platform 21 and spring urged into the workpiece path by spring 65. Except for an exposed tip 66 of high friction material, the face of scrubber 63 is covered with a low friction, long wearing liner 67. Scrubber 72 is similarly constructed. Both scrubbers cooperate with their associated feeders 22 and 23 to help separate workpieces before entering nip rollers 29 and 30 in the first feeder stage and nip rollers 73 and 74 in the second feeder stage.

Nip roller 29 is secured to shaft 68 rotatably carried on frame 21. Nip roller 30 is an idler rotatably carried on lever 69 fulcrumed at 70 on frame 21. Spring 71 urges lever 69 in a direction urging nip roller 30 towards nip roller 29 and into the path of the workpiece. Nip roller 29 is driven in a clockwise direction as viewed in FIG. 2 at a higher peripheral speed than feeder belt 50 so that workpieces exiting first stage feeder 22 are pinched between the nip rollers and accelerated along the workpiece path towards second stage feeder 23. The outer periphery of nip roller 29 is covered with a friction material 41 for positive gripping of workpieces. Nip rollers 73 and 74 are located at the exit end of second stage feeder 23 and constructed like their counterparts 29 and 30 described above.

Figure 3:
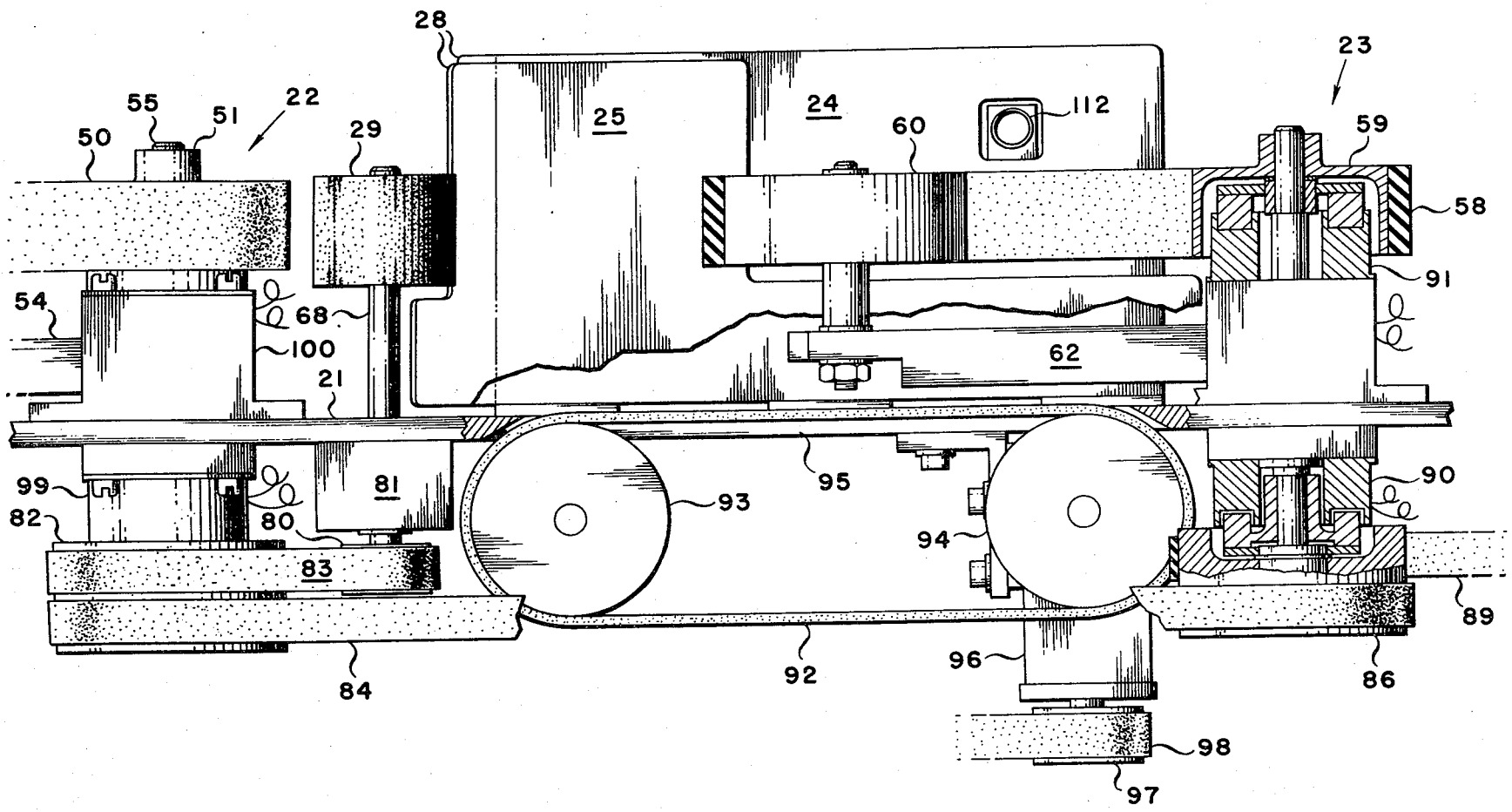
FIG. 3 is a view taken approximately on line 3—3 of FIG. 2.

Referring to FIGS. 3 and 4, shaft 68 for nip roller 29 projects through frame 21 and connects with a drive pulley 80. Suitable bearing means 81 secured to frame 21 rotatably supports the nip roller and drive pulley assembly. Nip roller drive pulley 80 connects with dual pulley 82 on the input shaft of first stage feeder 22 through belt 83. Pulley 82 is driven by motor 85 through belt 84 schematically shown in FIG. 4. Second stage feeder pulley 86 is also driven by motor 85 through belt 84. Belt 84 is coupled to the motor output shaft through pulley 87. Pulley 86, like pulley 82, is a dual pulley and drives nip roller 73 (FIG. 1) through belt 89. Idler wheel 88 shown in FIG. 4 serves to tension drive belt 84 and provide the needed amount of belt wrap around over motor output pulley 87 to avoid excessive slippage.

Pulleys 82 and 86 for the first and second stage feeders 22 and 23 are coupled to their associated feeder pulleys 51 and 59 through clutch-brake mechanism 90, 91 and clutch-brake mechanism 99, 100, respectively, to produce a forward pulsing motion at their respective feed belts 50 and 58, as hereinafter more particularly described, while their input pulleys 82 and 86 are driven at a nearly constant speed by motor 85. Clutches 90, 99 and brakes 91, 100 are of the electromagnetic type such as is manufactured by Warner Electric Clutch and Brake Company, Beloit, Wis. Warner Electric clutch model SF-160 and brake model RF-160 have been found acceptable for use with this invention.

To further augment the flow of workpieces into the second stage feeder, a belt conveyor 92 may be utilized in the floor of the workpiece path as shown in FIGS. 3 and 5. Belt 92 is carried on a pair of pulleys 93 and 94 in a slot 95 formed in frame 21. A right angle drive 96 transmits motion from drive pulley 97 to belt 92 through pulley 94. Drive belt 98 couples drive pulley 97 to the output of motor 85. Belt 92 is intended to be driven continuously by motor 85 as are nip rollers 29 and 73 while the feeder system is operating.

Figure 6:
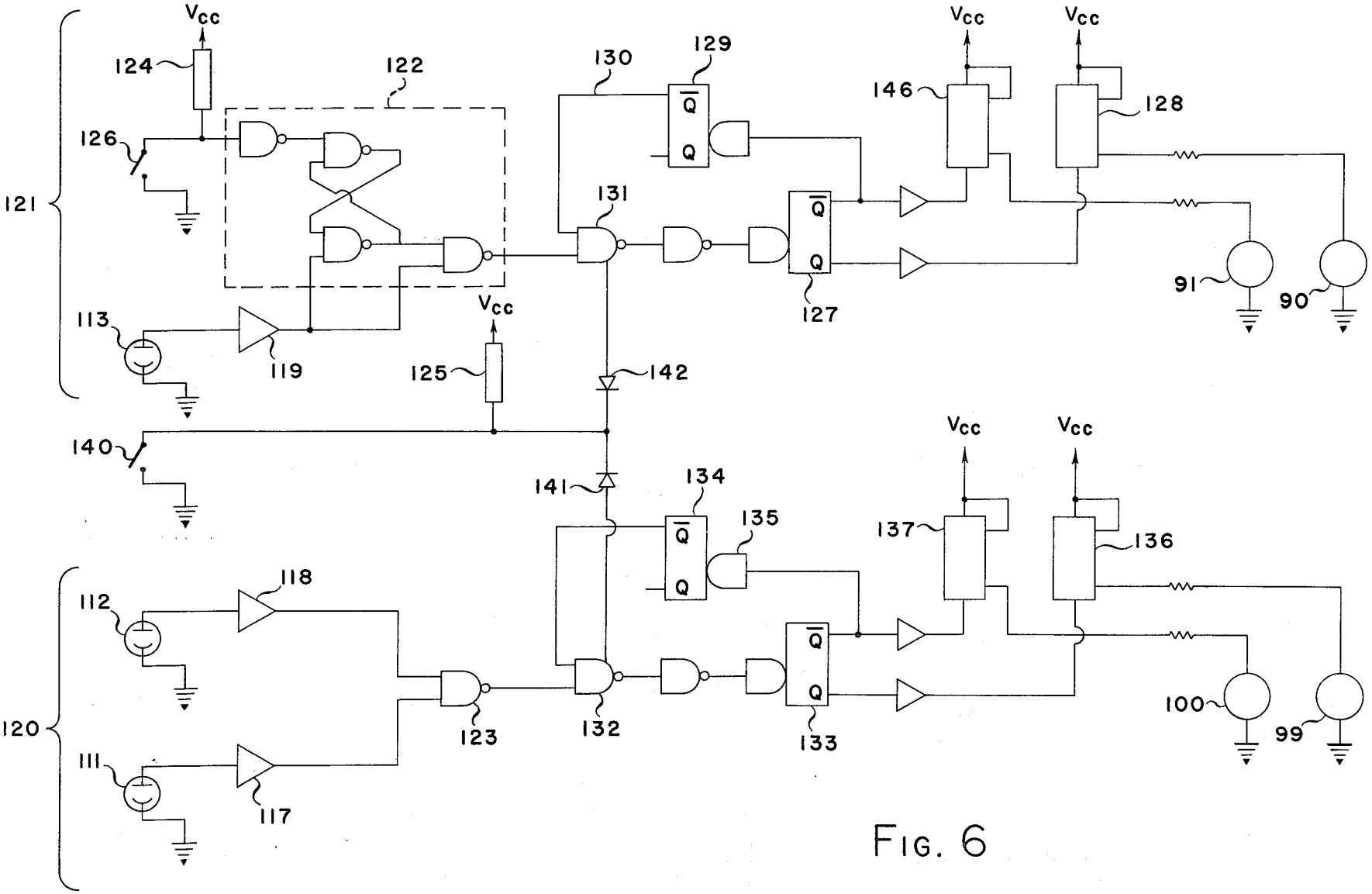
FIG. 6 is a schematic block diagram of the control electronics for the feeder device.

The control electronics for clutch-brake mechanism 90, 91 and clutch-brake mechanism 99, 100 is shown in FIG. 6. Photoelectric cells 111, 112 and 113 serving as switches in the FIG. 6 circuitry are strategically located as shown in FIGS. 1 and 2 along the workpieces path through feeding device 20. These photocells cooperate with light sources 114, 115 and 116, respectively, to form optical paths transverse to the workpiece path for detecting the presence/absence of a workpiece. As seen in FIGS. 1 and 2, photocell 111 and cooperating light source 114 are located to perform the detection function between first stage feeder 22 and nip rollers 29 and 30. Photocell 112 cooperates with light source 115 in second stage feeder 23 and photocell 113 cooperates with light source 116 downstream of the second stage feeder and upstream of nip rollers 73 and 74 to detect the presence/absence of a workpiece at each of these two locations.

Light sources 114, 115 and 116 (FIGS. 1 and 2) are coupled to a suitable source of electrical potential (not shown) and remain lighted during operation of the feeding device to provide a light beam directed at its cooperating photoelectric cell 111, 112 and 113, respectively. When a workpiece interrupts the light beam path, the photocell reacts as a switch in the circuit supplying the driver signals to the clutch-brake assemblies at the feeders. The output from these switching photocells 111, 112 and 113 are amplified in amplifiers 117, 118 and 119, respectively, to set nand gates controlling pulse forming circuits 120 and 121 driving the first and second stage feeder clutch-brake systems. Pulse forming circuit 120 drives clutch-brake mechanism 99, 100 in the first stage feeder through drivers 136 and 137 while pulse forming circuit 121 drives clutch-brake mechanism assembly 90, 91 in the second stage feeder through drivers 128 and 146.

Power to the control electronics is supplied by a voltage Vcc applied to the first and second stage pulse forming circuits 121 and 122. Dropping resistors 124 and 125 provide a contact voltage for switches 126 and 140, respectively.

Switch 126 in second stage feeder pulse forming circuit 121, working in conjunction with photocell 113, sets nand gate network 122 so as to trigger a one shot multivibrator 127 on command when an operator closes the switch. Triggering of one shot multivibrator 127 causes driver 146 to de-energize brake 91 and driver 128 to energize clutch 90. The output from one shot multivibrator 127 also triggers one shot multivibrator 129 in feedback loop 130 to recycle the multivibrators. So long as switch 126 remains closed, nand gate network 122 will continue to apply a potential allowing nand gate 131 to recycle multivibrator 127 and generate a continuous series of pulses to driver 128 for energizing clutch 90 and a continuous series of pulses to driver 146 for energizing brake 91, causing the second stage feeder to operate in a stop and go pulsing mode at the frequency of the input signal to the drivers. The preferred duration and frequency of the pulses are such as to turn the clutch-brake alternately on off on the order of every 60 milliseconds.

When switch 126 is opened on command of an operator, photocell 113 allows the recycling action of multivibrators 127 and 129 to continue until a workpiece blocks the photocell, or until stacker switch 140 is closed indicating a stacker empty condition.

Photocells 111 and 112 enable nand gate 123 in the first stage pulse forming circuit 120 when energized by their respective light sources. This enables nand gate 132 and allows one shot multivibrator 133 and one shot multivibrator 134 in the feedback loop to recycle and generate a continuous series of pulses to clutch driver 136 and brake driver 137 for clutch 99 and brake 100 in the first stage feeder 22. These series of pulses actuate first stage feeder 22 in a stop and go pulsing mode through drivers 136 and 137 in like manner as described above for second stage drivers 128 and 146, pulling workpieces from the stack and moving them through the feeding device. When one or the other or both photocells 111 and 112 are interrupted or switch 140 is closed, the cycling stops.

Drivers 128 and 146, and 136 and 137 are power transistors serving to drivingly couple the clutches and brakes with their associated multivibrators.

Stacker switch 140 senses the presence of workpieces loaded in the stacker to enable nand gates 131 and 132 in the first and second stage pulse forming circuits 120 and 121 through diodes 141 and 142. This conditions nand gates 131 and 132 to be responsive to command signals from photocells 111, 112 and 113 for triggering multivibrators 127 and 133. Stacker switch 140 is wired normally open so that when the stacker is empty the switch is closed and nand gates 131 and 132 are gated off or disabled.

As shown in FIGS. 1 and 2, stacker switch 140 is physically mounted on back plate 40 at the entrance to the feeding device. A spring loaded switch actuating lever 143 on switch 140 projects through a slot 144 formed in the back plate to be engaged by the workpieces, retracting the lever and holding the switch closed. When staker 31 is empty of workpieces, switch 140 opens, conditioning nand gates 131 and 132 in the feeder control circuits of FIG. 6 to block command signals from the photocells. A slot 145 formed in platen 34 provides the necessary clearance for lever 143 to prevent actuation of switch 140 by the platen as it moves towards the first stage feeder belt in emptying the stacker.

In operating the feeding device, machine sequence is controlled in two ways;

A. a command feed signal which calls for a workpiece to be fed, and

B. an automatic self priming cycle.

The command machine sequence is initiated by the closure of switch 126 in the control electronics circuitry, which might occur, for example, as an end of message key stroke from an operator keyboard (not shown). The call for a letter or other such workpiece signals pulse forming circuit 121 to actuate the clutch-brake drivers 128 and 146, causing a workpiece positioned in second stage feeder 23 to be moved into continuously rotating nip rollers 73 and 74. As the lead workpiece leaves the second stage feeder, photocell 112 detects that the workpiece has gone and signals first stage feeder 22 for another workpiece.

The automatic self priming cycle is initiated whenever photocell 112 detects the absence of a workpiece in second stage feeder 23. Workpieces loaded in stacker 31 are pushed against feed belt 50 as illustrated in FIG. 2 and under command of either or both photocells 111 and 112, feed belt 50 of first stage feeder 22 is pulsed forward, causing the next workpiece in the stack to be pulled from the stack and fed forward into the feeder system until the leading edge of the workpiece blocks photocell 111. If photocell 112 indicates an empty condition at the second stage feeder, the first stage feeder continues to operate to feed the workpiece into nip rollers 29 and 30 which accelerates the forward motion of the workpiece and deposits the workpiece in the mouth of the second stage feeder. If photocell 112 indicates that the second stage feeder is not empty, the first stage feeder stops when the leading edge of the workpiece blocks photocell 111 and before the workpiece reaches the nip rollers.

If accelerating nip rollers 29 and 30 do not propel the workpiece sufficiently into the second stage feeder so as to be grabbed by the feeder, continuously driven conveyor belt 92 in the floor of the workpiece path will carry it forward until positive contact is made.

As described above, once the lead workpiece is in the prime position at photocell 111, the continued movement of feed belt 50 is controlled by photocell 112. So long as the absence of a workpiece is detected at photocell 112, a signal is generated commanding first stage feeder 22 to continue pulsing feed belt 50 forward until the workpiece has entered the accelerating nip rollers 29 and 30. As the lead workpiece is rapidly advanced by the nip rollers towards second stage feeder 23, photocell 112 detects its presence at the second stage feeder and stops calling for further feeding of workpieces into the first stage. However, photocell 111 will command further driving of the first stage feeder belt until another workpiece is moved from the stack into position to block the photocell. Until photocell 112 detects an empty condition at the second stage feeder, there is no command for further driving of first stage feed belt 50 by that photocell. However, as soon as the second stage feeder is emptied, photocell 112 will issue a new command to the first stage feeder calling for a workpiece and the priming sequence will be automatically repeated.

If switch 126 in the control electronics of FIG. 6 is opened, photocell 113 will command second stage feeder 23 to stop its forward pulsing motion when the leading edge of the next workpiece is detected by the photocell. However, if switch 126 is closed, second stage feeder will continue its forward pulsing motion, feeding the workpieces one after the other into the continuously rotating high speed nip rollers 73 and 74, at the exit end of the feeding device.

In the event two or more workpieces are fed from first stage feeder 22 to second stage feeder 23 creating what is termed herein a "doubles" condition, the workpiece next to feed belt 58 in second stage feeder 23 is pulsed forward as the movement of the other workpiece(s), is retarded by the action of scrubber 72. The retarded workpiece(s) remaining in second stage feeder 23 blocks photocell 112 to delay the command for operation of first stage feeder 22 until the second stage feeder is emptied and capable of receiving another workpiece.

While a particular embodiment of the present invention has been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What I claim is:

1. A device for removing workpieces from a stack of workpieces for individual processing comprising, a plurality of feeders collectively from said stack of workpieces, at least one but not all of said plurality of feeders being arranged to engage said stack and remove workpieces therefrom on command, drive means for actuating said feeders to separate said workpieces as they are moved along said path, and sensor means to interdependently control the operation of said feeders, said sensor means including first detector means for sensing the presence of a workpiece at one feeder to inhibit actuation of a second feeder, and second detector means for sensing the absence of a workpiece between feeders to override said first detector means and command actuation of said second feeder.

2. A device as defined in claim 1 wherein said sensor means includes a photodetector at at least three strategic locations along said path.

3. A device as defined in claim 1 wherein the motion imparted by said drive means to at least one of said feeders is pulsating at a repetition rate greater than the rate workpieces are removed from the stack whereby to facilitate the separation of workpieces.

4. A device as defined in claim 1 including a movable scrubber cooperating with at least one of said feeders and located along said path on the side opposite said feeder for restraining the forward motion of workpieces.

5. A device as defined in claim 4 wherein said scrubber is spring urged into the workpiece path.

6. A device as defined in claim 4 including at least one pinch roller driven at a higher average peripheral velocity than the average peripheral velocity of said feeders for accelerating the movement of said workpieces along said path.

7. A device as defined in claim 6 wherein said pinch roller is located between said feeders.

8. A device as defined in claim 4 having a driven pinch roller at the exit end of each of the plurality of feeders.

9. A device as defined in claim 1 including a clutch mechanism interposed between said drive means and at least one of said feeders, and pulse generating means responsive to said sensor means for actuating said clutch mechanism to cyclically couple the feeder to said drive means and impart a forward pulsing motion to the feeder at a repetition rate greater than the rate workpieces are removed from the stack.

10. A device as defined in claim 9 including a brake mechanism for retarding the forward motion of the feeder during at least some intervals between clutch actuating pulses.

11. A device as defined in claim 9 wherein the pulse width of said clutch actuating pulses is on the order of 60 milliseconds.

12. A device as defined in claim 10 including a continuously moving conveyor for carrying workpieces between feeders.

13. A device as defined in claim 1 wherein said feeders each include a pair of spaced pulleys, a swing arm carrying one of said pulleys and hinged for limited swinging movement into said path, and a friction belt coupling said pulleys for rotation by said drive means through the other of said pulleys.

14. A device for removing workpieces from a stack of workpieces for individual processing comprising, a frame, first feeder means rotatably carried on said frame, drive means, first clutch means coupling said first feeder means to said drive means for rotating said first feeder means, said first feeder means being arranged to engage said stack for removing workpieces therefrom only on actuation of said first clutch means, second feeder means rotatably carried on said frame and arranged to receive workpieces removed from said stack by said first feeder means, second clutch means interposed between said drive means and said second feeder means for operatively coupling said drive means to rotate said second feeder means, clutch control means energizable for intermittently actuating said second clutch means to impart a pulsating motion to said second feeder means for separating multiple workpieces, detector means for sensing the presence of a workpiece at said second feeder means and inhibiting actuation of said first clutch means so long as there is a workpiece remaining in said second feeder means, and switch means for energizing said clutch control means on command of an operator.

15. A device as defined in claim 14 including a workpiece guide cooperating with said second feeder means to establish a workpiece path, said second feeder means being swingable into said path.

16. A device as defined in claim 14 including movable guide means carried on said frame and cooperating with said second feeder means to establish a variable width workpiece path.

* * * * *